US010075783B2

(12) United States Patent
Howes et al.

(10) Patent No.: US 10,075,783 B2
(45) Date of Patent: Sep. 11, 2018

(54) ACOUSTICALLY SUMMED REFERENCE MICROPHONE FOR ACTIVE NOISE CONTROL

(71) Applicant: Apple Inc., Cupertino, CA (US)

(72) Inventors: Michael B. Howes, San Jose, CA (US); Miikka O. Tikander, Sunnyvale, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 15/275,084

(22) Filed: Sep. 23, 2016

(65) Prior Publication Data

US 2018/0091883 A1 Mar. 29, 2018

(51) Int. Cl.

| | |
|---|---|
| ***G10K 11/16*** | (2006.01) |
| ***H04R 1/10*** | (2006.01) |
| ***G10K 11/178*** | (2006.01) |
| ***H04R 3/00*** | (2006.01) |

(52) U.S. Cl.

CPC ..... *H04R 1/1008* (2013.01); *G10K 11/178* (2013.01); *G10K 11/1788* (2013.01); *H04R 3/005* (2013.01); *G10K 2210/1081* (2013.01); *H04R 2460/11* (2013.01)

(58) Field of Classification Search

CPC .. H04R 1/1008; H04R 3/005; H04R 2460/11; H04R 1/1075; H04R 5/033; G10K 2210/1081; G10K 11/1788; G10K 2210/3045

See application file for complete search history.

(56) References Cited

U.S. PATENT DOCUMENTS

| | | | | |
|---|---|---|---|---|
| 4,324,951 | A | 4/1982 | Brown | |
| 4,777,650 | A | 10/1988 | Frederiksen | |
| 5,329,593 | A | 7/1994 | Lazzeroni et al. | |
| 5,452,268 | A | 9/1995 | Bernstein | |
| 6,108,415 | A | 8/2000 | Andrea | |
| 6,188,773 | B1 | 2/2001 | Murata et al. | |
| 6,788,791 | B2 | 9/2004 | Smith et al. | |
| 8,325,958 | B2 | 12/2012 | Rass | |
| 9,247,337 | B2 * | 1/2016 | Foudhaili ..... | H04R 1/1083 |
| 9,357,283 | B2 | 5/2016 | Darlington | |

(Continued)

FOREIGN PATENT DOCUMENTS

WO WO-2003041285 5/2003

*Primary Examiner* — Andrew L Sniezek

(74) *Attorney, Agent, or Firm* — Womble Bond Dickinson (US) LLP

(57) ABSTRACT

A headphone including a circumaural or supra-aural ear cup having an ear cup housing wall which forms an interior chamber within the ear cup. A transducer is positioned within the interior chamber for producing an acoustic output to a user and an active noise control assembly positioned within the interior chamber. The active noise control assembly including a reference microphone, the reference microphone is acoustically coupled to a plurality of reference input ports spaced around the ear cup housing wall such that a sound input from each of the different spacial locations around the ear cup housing wall is received by the reference microphone and acoustically summed to provide a reference audio signal indicative of the sound input at the different spacial locations. The headphone further including a processing circuit operable to generate an anti-noise signal from the reference audio signal.

17 Claims, 4 Drawing Sheets

(56) References Cited

U.S. PATENT DOCUMENTS

| | | | | |
|---|---|---|---|---|
| 2009/0103745 | A1 | 4/2009 | Grell et al. | |
| 2010/0226505 | A1* | 9/2010 | Kimura | G10K 11/1788 381/71.6 |
| 2011/0286607 | A1* | 11/2011 | Kimura | G10K 11/1788 381/71.6 |
| 2012/0076321 | A1 | 3/2012 | Ring et al. | |
| 2015/0163572 | A1 | 6/2015 | Weiss et al. | |
| 2017/0103746 | A1* | 4/2017 | Clemow | G10K 11/1788 |

* cited by examiner

ACOUSTICALLY SUMMED REFERENCE MICROPHONE FOR ACTIVE NOISE CONTROL

FIELD

An embodiment of the invention is directed to a reference microphone adapted for acoustic summation of sounds from different spacial locations around a headphone or headset for active noise control. Other embodiments are also described and claimed.

BACKGROUND

Whether listening to a portable media player while traveling, or to a stereo or theater system at home, consumers often choose headphones. Headphones typically include a pair of ear cups with associated earpads, and are held together by a headband. They can be classified into two general categories based on the size of the ear cups/earpads, namely circumaural (e.g., encompass the ear) or supra-aural (e.g., press against the ear). Both designs have their own acoustic advantages and disadvantages, but in most cases have some form of a passive noise control system or electronic active noise control system for reducing unwanted sounds from interfering with the desired sound output to the user. A passive noise control system may rely on the structure of the ear cup itself to passively or mechanically prevent unwanted noises from entering the ear cup (e.g., ear cup size, clamping force, vent, etc.). An active noise control (ANC) system is a noise (or unwanted sound) cancellation system which can electronically attenuate or cancel noise within the ear cup by, for example, emitting an "anti-noise" signal having the same amplitude and opposite phase to that of the noise such that they cancel each other out. For example, the ANC system may include a reference microphone, a cancelling speaker to output the anti-noise signal and an error microphone. The reference microphone may detect a reference input (e.g., unwanted ambient or environmental sounds), which is in turn used by the ANC system to generate the "anti-noise" signal, and the error microphone may be used to monitor a performance of the ANC system. In cases, however, where the reference input is coming from multiple directions, or a source that is otherwise not near the reference microphone, the reference microphone may not provide an accurate reference signal. To address this issue, multiple reference microphones are sometimes positioned at different spacial locations around the device housing. These discrete microphone signals are then summed electrically and used as a more spacially robust noise reference. Such systems, however, are electrically complex and may be rather costly.

SUMMARY

An embodiment of the invention is directed to a reference microphone for use in an active noise control (ANC) system in which acoustic summation of multiple sound inputs can occur at the reference microphone. Representatively, the assembly may include two or more acoustic input pathways that can receive an acoustic (or sound) input from different directions and/or spacial locations around the reference microphone (or a housing within which the reference microphone is used) and direct the sounds to the reference microphone. The sounds are then acoustically summed at the microphone diaphragm and used to provide a reference audio signal indicative of sounds at various spacial locations around the microphone (or an enclosure within which the microphone is used). The reference audio signal may be equivalent to a reference signal produced by electrical summation using multiple microphones. The reference microphone described herein can therefore achieve a reference signal indicative of sounds (e.g., sound pressures) at multiple locations using only one reference microphone. It is further contemplated that the reference microphone may be used in an ANC system on the down link (far end) signal (e.g., to cancel an unwanted sound on the far end signal at the headphones), as opposed to an up link signal application (e.g., a microphone for ANC within a telephone).

More specifically, in one embodiment, the invention includes a headphone including a circumaural or supra-aural ear cup with an ear cup housing wall that forms an interior chamber within the ear cup. A transducer is positioned within the interior chamber for producing an acoustic output to a user. In addition, the headphone includes an active noise control assembly positioned within the interior chamber. The active noise control assembly may include a reference microphone and an error microphone. The reference microphone may be acoustically coupled to a number of reference input ports spaced around the ear cup housing wall such that a sound input from each of the different spacial locations around the ear cup housing wall is received by the reference microphone and acoustically summed to provide a reference audio signal indicative of the sound input at the different spacial locations. The headphone may also include a processing circuit operable to generate an anti-noise signal from the reference audio signal for countering effects of unwanted ambient sounds in the acoustic output of the transducer. In one embodiment, the reference input ports are open to an ambient environment outside of the ear cup housing wall. In addition, the reference input ports may be evenly spaced around the ear cup housing wall. The reference microphone may be acoustically coupled to the plurality of reference input ports by a plurality of acoustic input pathways extending in different directions from the reference microphone. In some embodiments, the plurality of acoustic input pathways are substantially the same length. In some embodiments, the reference audio signal is substantially equivalent to an electrical summation produced using a plurality of microphones at the different spacial locations around the ear cup housing wall. The reference microphone may be considered an omnidirectional microphone because it can receive sound inputs from different directions. The sound input to the reference microphone from each of the different spacial locations as previously discussed may be received along a single side of a diaphragm within the reference microphone.

In another embodiment, a noise cancelling headphone including an ear cup, a transducer and an active noise control assembly is disclosed. The ear cup may be formed by an ear cup housing wall having an exterior surface to an ambient environment outside of the ear cup and an interior surface defining an interior chamber. The transducer may be positioned within the interior chamber for producing an acoustic output to a user. The active noise control assembly may further be positioned within the interior chamber and include a reference microphone module. The reference microphone module may include a first acoustic input pathway extending in a first direction from a reference microphone within the module to the exterior surface of the ear cup housing wall and a second acoustic input pathway extending in a second direction from the reference microphone to the exterior surface of the ear cup housing wall. The first direction and the second direction are different such that the reference microphone receives an omnidirectional acoustic input that is acoustically summed at the reference microphone. In some cases, the first acoustic input pathway and the second acoustic input pathway are acoustically coupled to a same side of a diaphragm within the reference microphone. In addition, the first acoustic input pathway and the second acoustic input pathway may be acoustically coupled to a first input port and a second input port, respectively, formed through the ear cup housing wall at different spacial locations along the ear cup housing wall. In some embodiments, the headphone may include a third acoustic input pathway extending in a third direction from the reference microphone to the exterior surface of the ear cup housing wall, and the third direction is different from the first direction and the second direction. The third acoustic input pathway may be acoustically coupled to a third input port formed through the ear cup housing wall, and the first input port, the second input port and the third input port are at substantially evenly spaced locations around the ear cup housing wall.

In other embodiments, a reference microphone assembly for an active noise control system is disclosed. The reference microphone assembly may include a housing and a reference microphone mounted to the housing. The housing may have a first acoustic input pathway and a second acoustic input pathway. The first acoustic input pathway may be configured to receive a first sound input from a first direction and the second acoustic input pathway may be configured to receive a second sound input from a second direction different than the first direction. The reference microphone may be acoustically coupled to the first acoustic input pathway and the second acoustic input pathway such that the reference microphone receives the first sound input and the second sound input, and the first sound input and the second sound input are acoustically summed at the reference microphone. In some embodiments, a sound input port to the first acoustic input pathway faces a different direction than a sound input port to the second acoustic input pathway. In addition, the first acoustic input pathway and the second acoustic input pathway may be acoustically coupled to different sound input ports in a headphone ear cup housing wall. In still further embodiments, the housing is coupled to an interior surface of an ear cup housing wall of a headphone, and the first acoustic input pathway is acoustically coupled to a first sound input port formed through the ear cup housing wall and the second acoustic input pathway is acoustically coupled to a second sound input port formed through the ear cup housing wall. In some cases, the first acoustic input pathway and the second acoustic input pathway may be substantially the same length. The microphone module may also include a third acoustic input pathway configured to receive a third sound input from a third direction, wherein the third direction is different than the first direction and the second direction. The reference microphone may be operable to generate a reference audio signal indicative of the acoustically summed sound input for use in an active noise control system.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

Figure 1:
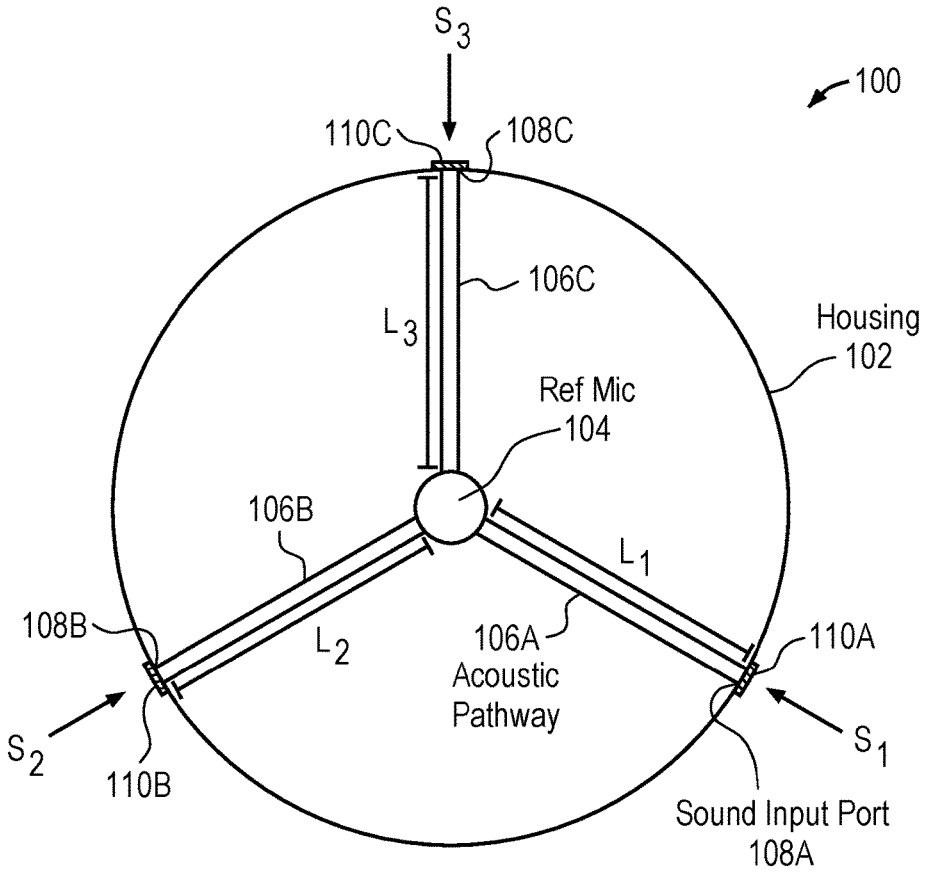
FIG. 1 illustrates a top view schematic diagram of one embodiment of a reference microphone assembly.

FIG. 1 illustrates a top view schematic diagram of one embodiment of a reference microphone assembly. Reference microphone assembly 100 may include a housing 102 and a reference microphone 104 mounted to housing 102. Housing 102 may be any type of enclosure to which the reference microphone 104 and its associated components can be mounted or enclosed within. For example, in one embodiment, housing 102 may be a reference microphone module within which the reference microphone is mounted, and which can then be used to mount the reference microphone within the desired audio device. In another embodiment, housing 102 may be an enclosure for an audio device within which the reference microphone 104 is used, for example an ear cup housing. Reference microphone 104 may be any type of acoustic-to-electric transducer or sensor that converts sound into an electrical signal. In this aspect, although not explicitly shown, reference microphone 104 may include, for example, a sound pick up surface (e.g., a diaphragm), a moving coil and magnet assembly, or may be a MEMS microphone. In addition, it should be understood that reference microphone 104 is referred to as a "reference" microphone because it is intended to be used to pick up sounds (e.g., unwanted sounds) and produce a reference signal indicative of those sounds for use within an ANC system.

More specifically, reference microphone 104 may sample sounds, or otherwise pick up a sound reference signal, indicative of sound pressures at multiple locations around housing 102 and provide an acoustic summation of those sounds for use by the ANC system. Representatively, housing 102 may include a number of acoustic pathways 106A, 106B and 106C extending from reference microphone 104 to a number of acoustic input ports 108A, 108B and 108C formed through an exterior surface of housing 102. In one embodiment, acoustic input ports 108A-108C may be open to an ambient environment outside of housing 102 such that they can be used to detect unwanted ambient sounds (e.g., noise). Acoustic input ports 108A-108C may further be positioned at different spacial locations around housing 102 such that sounds $S_1$, $S_2$ and $S_3$ at these different locations can be sampled by reference microphone 104. For example, acoustic input ports 108A-108C could be at locations around housing 102 where three reference microphones would be positioned in a multiple reference microphone ANC system. Representatively, in one embodiment, acoustic input ports 108A-108C may be evenly spaced around an exterior surface of housing 102. Other configurations, however, are also contemplated. For example, acoustic input ports 108A-108C may be at different locations around housing 102 but unevenly spaced, or depending upon a shape of housing 102, along different sides of housing 102.

In addition, in some embodiments, each of acoustic input ports 108A-108C may face different directions such that they can pick up omnidirectional sounds $S_1$-$S_3$ (e.g., sounds traveling in different directions as illustrated by the arrows). For example, each of sounds $S_1$-$S_3$ may originate from sound sources at different locations around housing 102, and therefore travel toward housing 102 in different directions. Since each of acoustic input ports 108A-108C face the direction of the respective sound sources, they can more directly pick up sounds $S_1$-$S_3$ from these sources. In this aspect, reference microphone 104 may also be referred to as an omnidirectional microphone in that it can pick up sounds coming from various directions. It should further be understood that, in some embodiments, the direction in which sounds $S_1$-$S_3$ travel is toward a side of reference microphone 104, as opposed toward an acoustic pick-up surface (e.g., diaphragm) of reference microphone 104. Acoustic input ports 108A-108C may have any size and shape suitable for picking up sounds $S_1$-$S_3$. In addition, although three acoustic input ports 108A-108C are illustrated, it is contemplated that any number of acoustic input ports 108A-108C may be used, for example, housing 102 may have at least two or more acoustic input ports.

In addition, in some embodiments, a damping member may be associated with one or more of acoustic input ports 108A-108C and/or acoustic input pathways 106A-106C to address possible resonances in the pathways. Representatively, in one embodiment, damping members 110A, 110E and 110C are positioned over each of acoustic input ports 108A, 108B and 108C, respectively. In this aspect, damping members 110A-110C may be made of an acoustic mesh sufficient to achieve damping at higher frequencies without interfering with ANC operations (e.g., frequencies less than 3 kHz). In other embodiments, the damping members may be made of a porous material such as a cloth or foam that is positioned inside of each of acoustic input pathways 106A-106C. For example, the porous cloth or foam material may completely fill each of acoustic input pathways 106A-106C to completely eliminate all resonances.

As previously discussed, acoustic input pathways 106A-106C may extend from reference microphone 104 to each of acoustic input ports 108A-108C, respectively. In this aspect, sounds $S_1$-$S_3$ entering acoustic input ports 108A-108C travel through acoustic input pathways 106A-106C to reference microphone 104. In some embodiments, each of acoustic input pathways 106A-106C may have an acoustic length $L_1$, $L_2$, and $L_3$, respectively. In other words, acoustic input pathways 106A-106C are not simply holes, but rather pathways having a defined acoustic length along which sound must travel to reach reference microphone 104. Each of acoustic lengths $L_1$-$L_3$ may be acoustically the same. It is contemplated, however, that in some embodiments where it is known that certain sounds sources are closer/farther than others, one or more of acoustic lengths $L_1$-$L_3$ of acoustic input pathways 106A-106C may be different to accommodate these sound sources at known locations (e.g., an acoustic input pathway aligned with a closer sound source may be shorter than the others). In addition, as shown in FIG. 1, each of acoustic input pathways 106A-106C may extend in different directions from reference microphone 104. For example, each of acoustic input pathways 106A-106C may extend toward, and connect to, acoustic input ports 108A-108C in different sides of housing 102. In this aspect, in one embodiment, each of acoustic input pathways 106A-106C form an angle with respect to one another and are otherwise not parallel with one another.

The sounds $S_1$-$S_3$ input to reference microphone 104 from the different spacial locations around housing 102 as previously discussed can then be combined at the sound pick-up surface (e.g., diaphragm) within microphone 104 and acoustically summed to produce a reference signal indicative of sounds (e.g., unwanted background noises) sampled from multiple locations for ANC. Reference microphone assembly 100 therefore allows for a more spacially robust reference signal for ANC than that which is typically achieved using a single reference microphone (which samples sound from a single location), without the need for multiple reference microphones. It should further be understood that reference microphone 104 with multiple input pathways for multi-sound input as disclosed herein is operable within a desired frequency range for ANC (e.g., up to about 2 kHz).

Figure 2:
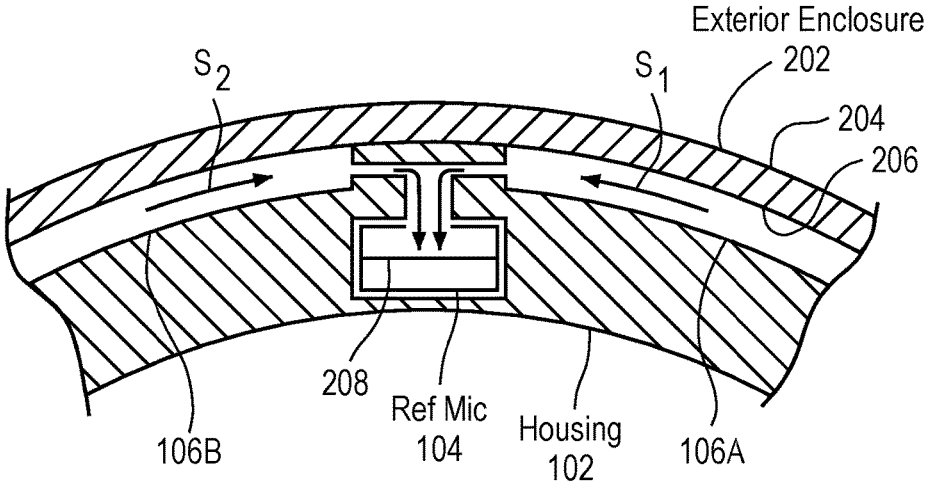
FIG. 2 illustrates a side view schematic diagram of the reference microphone assembly of FIG. 1 coupled with an exterior housing.

FIG. 2 illustrates a side view schematic diagram of the reference microphone assembly of FIG. 1 coupled with an exterior housing. In particular, in this embodiment, housing 102 and reference microphone 104 are shown mounted within an exterior enclosure 202. Exterior enclosure 202 may, for example, be an ear cup enclosure for a headphone device. In this aspect, exterior enclosure 202 may have a cosmetic exterior surface 204 and an interior surface 206 that forms an interior chamber within which housing 102 and reference microphone 104 of reference microphone assembly 100 are positioned. Reference microphone 104 is further shown mounted within housing 102. From this view, it can be seen that when housing 102 is mounted to the interior surface 206 of exterior enclosure 202, acoustic pathways 106A and 106B are positioned between housing 102 and exterior enclosure 202 and provide an acoustic pathway for sound $S_1$ and $S_2$ to travel to reference microphone 104. In addition, it can be seen that sound $S_1$ and $S_2$ are both input to the same sound pick-up face of diaphragm 208 such that they can be acoustically summed within an acoustic domain of reference microphone 104.

Figure 3:
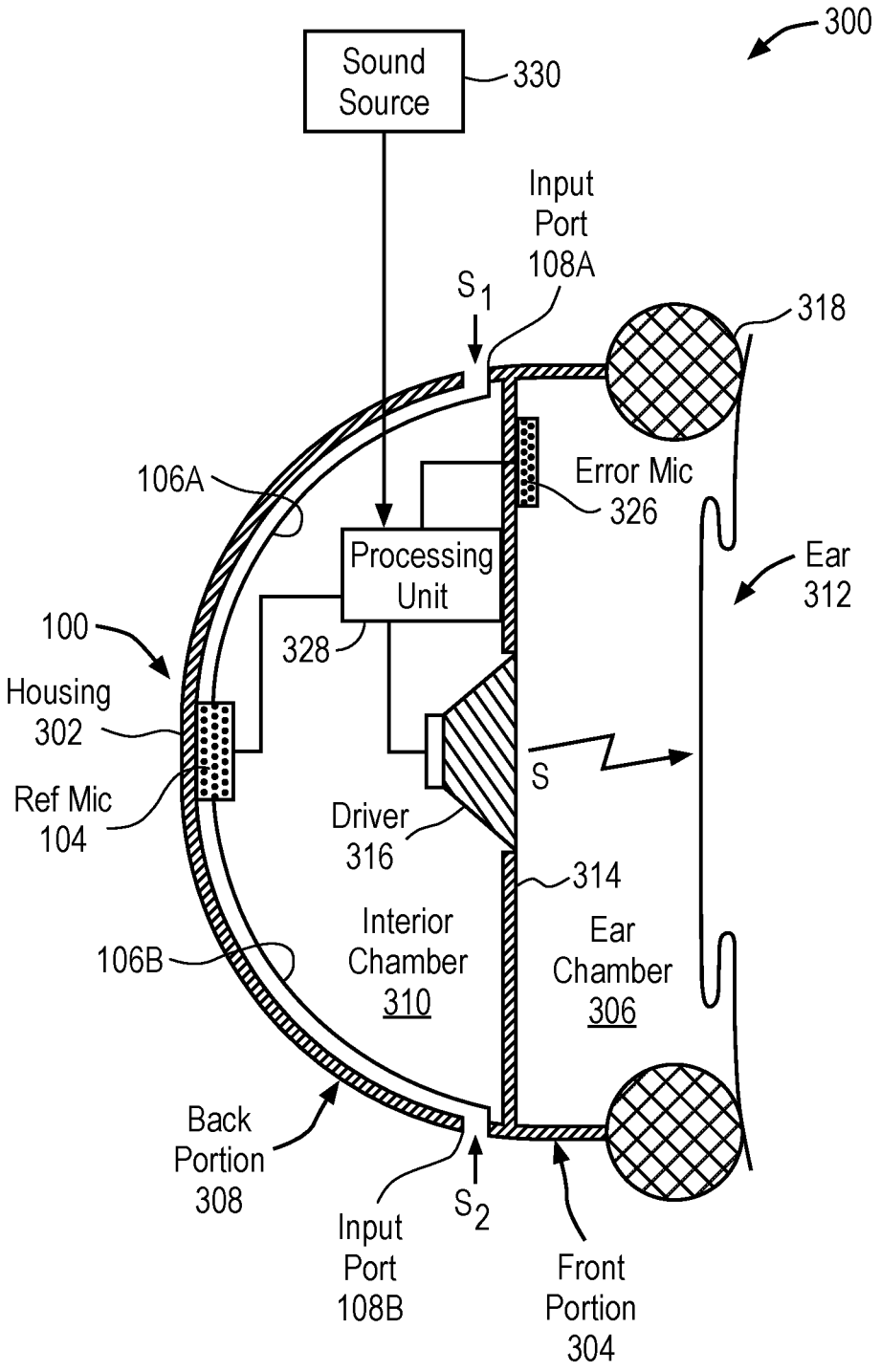
FIG. 3 illustrates a side view schematic diagram of the reference microphone assembly of FIG. 1 implemented within an ear cup.

FIG. 3 illustrates a side view schematic diagram of the reference microphone assembly of FIG. 1 implemented within an ear cup. In particular, microphone assembly 100 is shown positioned within ear cup 300. Ear cup 300 may be a left or right ear cup of a headphone assembly, and may be circumaural or supra-aural as previously discussed. Ear cup 300 includes ear cup housing wall 302, which forms an enclosure dimensioned to encircle and/or cover a user's ear. Ear cup housing wall 302 may include a front portion 304 defining an ear chamber 306 and a back portion 308 defining an interior chamber 310 within ear cup 300. Ear chamber 306 may surround the ear 312 when ear cup 300 is positioned on the user's head. In some cases, an earphone pad 318 may be positioned around front portion 304 of ear cup housing wall 302 to ensure a comfortable fit around the user's ear. Interior chamber 310 may be a substantially closed chamber positioned behind the ear chamber 306 (as viewed in FIG. 3). Interior chamber 310 may be separated from ear chamber 306 by mid wall 314.

A transducer or driver 316 for outputting a music signal (S) in a direction of ear 312 may be mounted within mid wall 314. Driver 316 may be any type of electric-to-acoustic transducer having a pressure sensitive diaphragm and circuitry configured to produce a sound in response to an electrical audio signal input (e.g., a loudspeaker). The electrical audio signal may be a music signal input to driver 316 by sound source 330. Sound source 330 may be any type of audio device capable of outputting an audio signal, for example, an audio electronic device such as a portable music player, home stereo system or home theater system capable of outputting an audio signal.

In order to improve an acoustic performance of ear cup 300, an ANC assembly including reference microphone assembly 100 may be positioned within ear cup 300. The ANC assembly may include any type of active noise cancelling system capable of emitting a cancelling or anti-noise signal for cancelling noise within ear cup 300. For example, active noise control assembly may be a feedback and/or feedforward ANC system. Representatively, in one embodiment, the ANC assembly may include reference microphone assembly 100 including reference microphone 104 for detecting unwanted background sounds and an error microphone 326 for detecting sounds within ear chamber 306. As shown in FIG. 3, reference microphone assembly 100 may be positioned within interior chamber 310 and acoustically coupled to acoustic input ports 108A, 108B at different locations along ear cup housing wall 302. For example, reference microphone 104 may be positioned near a center of ear cup housing wall and acoustically coupled to input ports 108A, 108B formed through ear cup housing wall 302 (near ear pads 318) via acoustic input pathways 106A, 106B. In this aspect, sounds $S_1$ and $S_2$ (e.g., unwanted backrounds sounds) at various locations around ear cup housing 302 can be detected and input to reference microphone 104 for acoustic summation as previously discussed.

Similar to reference microphone 104, error microphone 326 may be any type of acoustic-to-electric transducer or sensor having a pressure sensitive diaphragm and circuitry capable of converting ear cup sounds into an electrical signal (e.g., a MEMS microphone). Error microphone 326 may mounted within ear chamber 306 so that it can detect sounds that could be heard by a user and interfere with the listening experience. The ear cup sounds detected by error microphone 326 may then be converted to an ear cup noise electrical signal and transmitted to processing unit 328. Processing unit 328 may then process both the ear cup noise electrical signal and the reference signal from reference microphone 104 to determine whether ANC is necessary. Where ANC is necessary, processing unit 328 will generate a cancelling or anti-noise signal having an amplitude equal to, but of a different phase than, the ear cup sounds to be cancelled. The cancelling signal will then be transmitted from processing unit 328 to driver 316, which in turn, outputs the cancelling signal to ear chamber 306 so that any undesired ear cup sound is cancelled before reaching the user's ear. The cancelling signal may be transmitted along with, or separate from, a music signal (S) transmitted to driver 316 by sound source 330 for output to the user.

Figure 4:
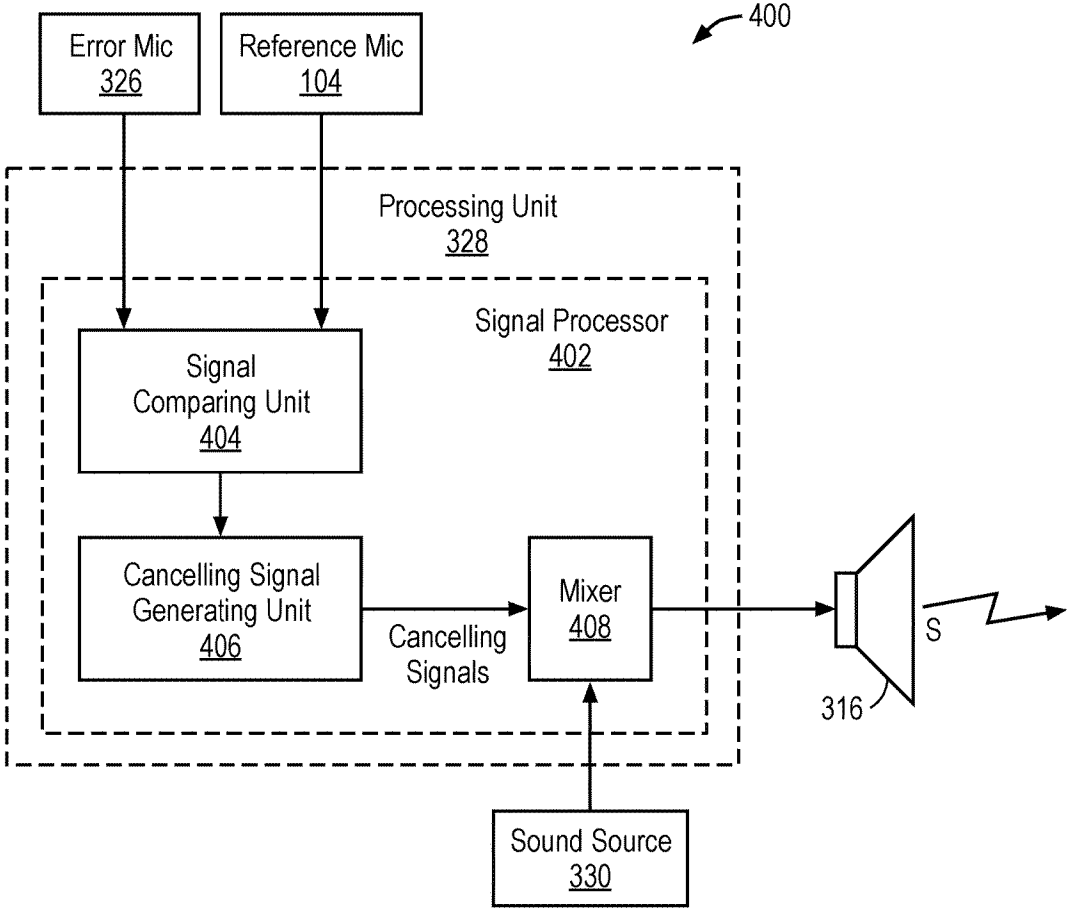
FIG. 4 illustrates a block diagram showing one embodiment of an operation of a noise control assembly.

FIG. 4 illustrates a block diagram showing one embodiment of an operation of an active noise control assembly. Active noise control assembly 400 may include processing unit 328, which includes various processing components configured to drive the operation of the active noise control assembly as will now be described in more detail. In one embodiment, processing unit 328 may include a signal processor 402, which may in some embodiments be a digital signal processor (DSP). Signal processor 402 may include various signal processing components, including but not limited to, a signal comparing unit 404, a cancelling signal generating unit 406 and a mixer 408 for processing of the reference electrical signals from reference microphone 104 and/or electrical signals from error microphone 326. Representatively, during an operation of ear cup 300, signal comparing unit 404 can compare the acoustically summed reference signal from reference microphone 104, the electrical signals from error microphone 326 and/or music sound signals (S) to each other and/or a threshold value, to determine whether ANC is necessary. Where ANC is necessary, instructions may then be sent to cancelling signal generating unit 406 to generate a cancelling signal or anti-noise signal sufficient to cancel any unwanted sounds. The cancelling signals generated by cancelling signal generating unit 406 may then be sent to mixer 408. The cancelling signal output by cancelling signal generating unit 406 may be synthesized with the musical signal (S) input by sound source 330 and sent to driver 316 for output to the user (see FIG. 3).

Although not illustrated in FIG. 4, it is to be understood that, a battery or other power source for ANC assembly 400 may be included within the associated headphone. It is further to be understood that ANC assembly 400 is shown generically in FIG. 4 for clarity. Persons skilled in the art can, however, appreciate that any one or more of the components discussed herein can be omitted, modified, combined, and/or rearranged, and any additional processing components and/or circuitry necessary for processing of sound electrical signals and operation of an ANC assembly may be included without departing from the scope of the invention. Representative components and/or circuitry that may be included but are not illustrated in FIG. 4 may include, but are not limited to, amplifiers, filters, phase adjusters, signal converters, memory, additional processors and the like. It is further to be understood that in some embodiments, each of the components and/or circuitry of processing unit 328 are integrated within ear cup 300 (of the associated headphone in general) such that the signal processing and operating decisions take place within ear cup 300. In other embodiments, one or more components of processing unit 328 may be integrated within an electronic device remote to ear cup 300 such that signal processing and/or operating decisions are performed outside of ear cup 300 and the operating instructions are transferred to ear cup 300 (e.g., via a wire or wirelessly) for execution. For example, processing unit 328 (including, for example, signal comparing unit 404, cancelling signal generating unit 406 and mixer 408) may be integrated within sound source 330 or a chip configured to collect noise electrical signals, process the signals and transfer the signals, in some cases along with instructions, to a host device.

Figure 5:
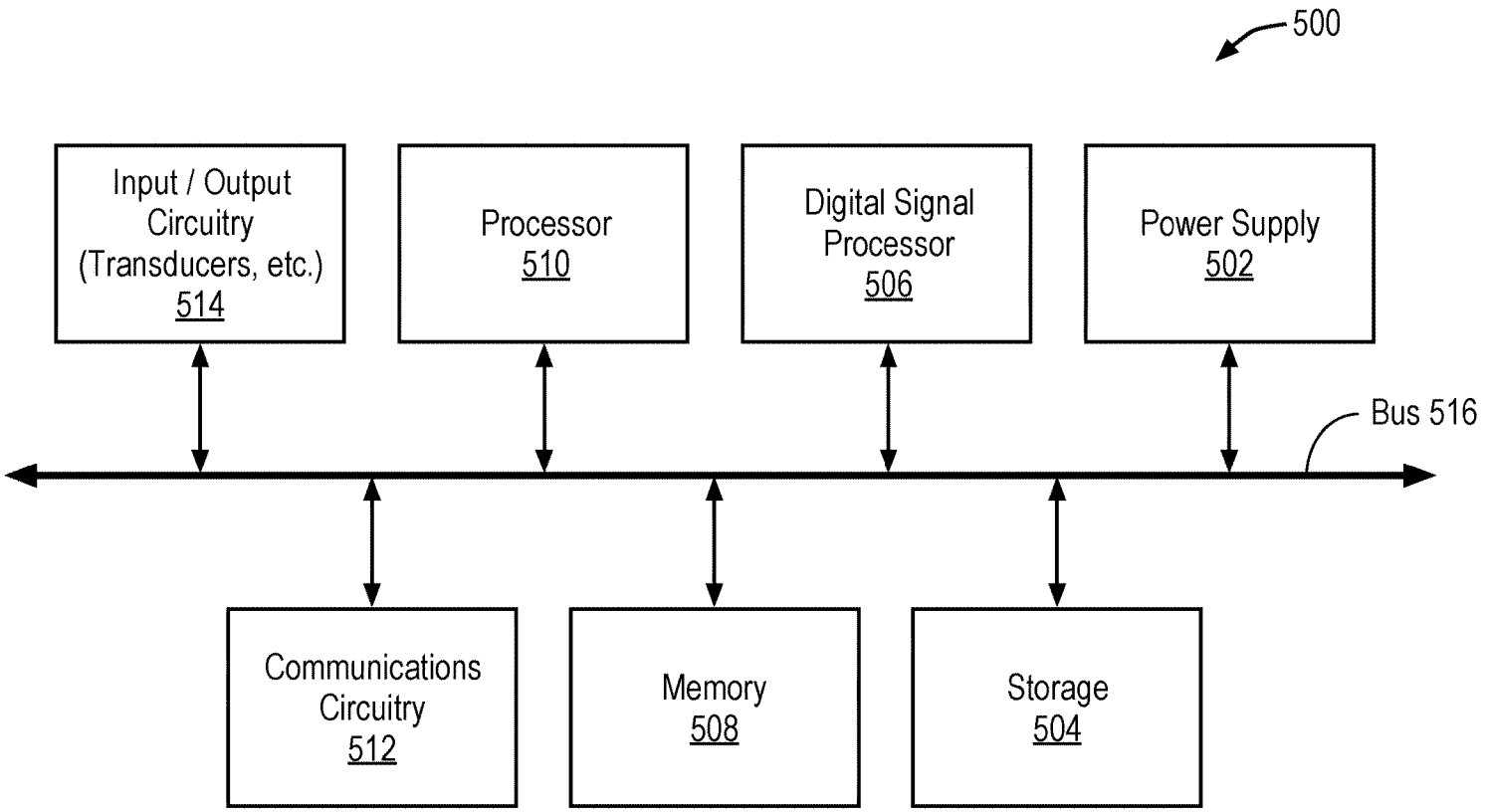
FIG. 5 is a simplified logic flow chart of an illustrative mode of operation in accordance with one embodiment of an active noise control assembly.

FIG. 5 illustrates a simplified schematic view of one embodiment of an electronic device in which an active noise control assembly may be implemented. For example, ear cup 300 (including the associated headphone assembly) is an example of a system that can include some or all of the circuitry illustrated by electronic device 500.

Electronic device 500 can include, for example, power supply 502, storage 504, signal processor 506, memory 508, processor 510, communication circuitry 512, and input/output circuitry 514. In some embodiments, electronic device 500 can include more than one of each component of circuitry, but for the sake of simplicity, only one of each is shown in FIG. 5. In addition, one skilled in the art would appreciate that the functionality of certain components can be combined or omitted and that additional or less components, which are not shown in FIGS. 1-4, can be included in, for example, ear cup 300.

Power supply 502 can provide power to the components of electronic device 500. In some embodiments, power supply 502 can be coupled to a power grid such as, for example, a wall outlet. In some embodiments, power supply 502 can include one or more batteries for providing power to an ear cup, headphone or other type of electronic device associated with the headphone. As another example, power supply 502 can be configured to generate power from a natural source (e.g., solar power using solar cells).

Storage 504 can include, for example, a hard-drive, flash memory, cache, ROM, and/or RAM. Additionally, storage 504 can be local to and/or remote from electronic device 500. For example, storage 504 can include integrated storage medium, removable storage medium, storage space on a remote server, wireless storage medium, or any combination thereof. Furthermore, storage 504 can store data such as, for example, system data, user profile data, and any other relevant data.

Signal processor 506 can be, for example a digital signal processor, used for real-time processing of digital signals that are converted from analog signals by, for example, input/output circuitry 514. After processing of the digital signals has been completed, the digital signals could then be converted back into analog signals. For example, the signal processor 506 could be used to analyze digitized audio signals received from reference or error microphones to determine how much of the audio signal is ambient noise or ear cup noise and how much of the audio signal is, for example, music signals.

Memory 508 can include any form of temporary memory such as RAM, buffers, and/or cache. Memory 508 can also be used for storing data used to operate electronic device applications (e.g., operation system instructions).

In addition to signal processor 506, electronic device 500 can additionally contain general processor 510. Processor 510 can be capable of interpreting system instructions and processing data. For example, processor 510 can be capable of executing instructions or programs such as system applications, firmware applications, and/or any other application. Additionally, processor 510 has the capability to execute instructions in order to communicate with any or all of the components of electronic device 500. For example, processor 510 can execute instructions stored in memory 508 to enable or disable ANC.

Communication circuitry 512 may be any suitable communications circuitry operative to initiate a communications request, connect to a communications network, and/or to transmit communications data to one or more servers or devices within the communications network. For example, communications circuitry 512 may support one or more of Wi-Fi (e.g., a 802.11 protocol), Bluetooth®, high frequency systems, infrared, GSM, GSM plus EDGE, CDMA, or any other communication protocol and/or any combination thereof.

Input/output circuitry 514 can convert (and encode/decode, if necessary) analog signals and other signals (e.g., physical contact inputs, physical movements, analog audio signals, etc.) into digital data. Input/output circuitry 514 can also convert digital data into any other type of signal. The digital data can be provided to and received from processor 510, storage 504, memory 508, signal processor 506, or any other component of electronic device 500. Input/output circuitry 514 can be used to interface with any suitable input or output devices, such as, for example, reference microphone 104, error microphone 326 or sound source 330 of FIGS. 1-3. Furthermore, electronic device 500 can include specialized input circuitry associated with input devices such as, for example, one or more proximity sensors, accelerometers, etc. Electronic device 500 can also include specialized output circuitry associated with output devices such as, for example, one or more speakers, earphones, etc.

Lastly, bus 516 can provide a data transfer path for transferring data to, from, or between processor 510, storage 504, memory 508, communications circuitry 512, and any other component included in electronic device 500. Although bus 516 is illustrated as a single component in FIG. 5, one skilled in the art would appreciate that electronic device 500 may include one or more components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, the ANC system including reference microphone as described herein may be used to improve an acoustic response of any type of earpiece with acoustic capabilities, for example, earbuds, earphones, intra-canal earphones, intra-concha earphones or a mobile phone headset. The description is thus to be regarded as illustrative instead of limiting.

What is claimed is:

1. A headphone comprising:

a circumaural or supra-aural ear cup having an ear cup housing wall which forms an interior chamber within the ear cup;

a transducer positioned within the interior chamber for producing an acoustic output to a user;

an active noise control assembly positioned within the interior chamber, the active noise control assembly comprising a reference microphone, wherein the reference microphone is acoustically coupled to at least three reference input ports arranged at different spatial locations around the ear cup housing wall and facing at least three different directions, respectively, each direction being perpendicular to a direction faced by a sound pick-up surface of the reference microphone, and wherein a sound input from each of the different spatial locations around the ear cup housing wall is received by the reference microphone and acoustically summed to provide a reference audio signal indicative of the sound input at the different spatial locations; and a processing circuit operable to generate an anti-noise signal from the reference audio signal for countering effects of unwanted ambient sounds in the acoustic output of the transducer.

2. The headphone of claim 1 wherein the reference input ports are open to an ambient environment outside of the ear cup housing wall.

3. The headphone of claim 1 wherein a space between each of the reference input ports arranged around the ear cup housing wall is the same.

4. The headphone of claim 1 wherein the reference microphone is directly connected to the reference input ports by a plurality of acoustic input pathways having portions extending in different directions from the reference microphone.

5. The headphone of claim 4 wherein the different directions are in a radial direction extending from a side of the reference microphone to the earcup housing wall, and the plurality of acoustic input pathways comprise substantially a same length.

6. The headphone of claim 1 wherein the reference audio signal is substantially equivalent to an electrical summation produced using a plurality of microphones at the different spatial locations around the ear cup housing wall.

7. The headphone of claim 1 wherein the reference microphone is an omnidirectional microphone.

8. The headphone of claim 1 wherein the sound input from each of the different spatial locations is received by the sound pick-up surface within the reference microphone.

9. A noise cancelling headphone comprising:

an ear cup formed by an ear cup housing wall, the ear cup housing wall having an exterior surface exposed to an ambient environment outside of the ear cup and an interior surface defining an interior chamber;

a transducer positioned within the interior chamber for producing an acoustic output to a user; and an active noise control assembly positioned within the interior chamber, the active noise control assembly comprising a reference microphone module, the reference microphone module having a reference microphone mounted to a module wall, the module wall in combination with the interior surface of the earcup housing wall forms at least a first acoustic input pathway, a second acoustic input pathway and a third acoustic input pathway, the first acoustic input pathway extending in a first radial direction from the reference microphone to a first input port through the exterior surface of the ear cup housing wall, the second acoustic input pathway extending in a second radial direction from the reference microphone to a second input port through the exterior surface of the ear cup housing wall, and the third acoustic input pathway extending in a third radial direction from the reference microphone to a third input port through the exterior surface of the ear cup housing wall, wherein the first radial direction, the second radial direction, and the third radial direction are different, and at least the first input port, the second input port, and the third input port are at evenly spaced locations around the ear cup housing wall, such that the reference microphone receives an omnidirectional acoustic input that is acoustically summed at the reference microphone.

10. The headphone of claim 9 wherein the first radial direction and the second radial direction are perpendicular to a direction faced by a sound pick-up surface of the reference microphone, and the first acoustic input pathway and the second acoustic input pathway are acoustically coupled to the sound pick-up surface within the reference microphone.

11. The headphone of claim 9 wherein the first acoustic input pathway and the second acoustic input pathway are acoustically coupled to the first input port and the second input port, respectively, formed through the ear cup housing wall at different spatial locations along the ear cup housing wall and which are radially outward to the reference microphone.

12. A reference microphone assembly for an active noise control system, the microphone assembly comprising:

a housing having a first acoustic input pathway, a second acoustic input pathway and a third acoustic input pathway, each of the first, second and third acoustic input pathways having a length dimension defined by a surface interior to the housing, and each length dimension being substantially the same, wherein the first acoustic input pathway is configured to receive a first sound input from a first direction, the second acoustic input pathway is configured to receive a second sound input from a second direction different than the first direction, and the third acoustic input pathway is configured to receive a sound input from a third direction different than the first direction and the second direction; and a reference microphone mounted to the housing, the reference microphone is acoustically coupled to the first acoustic input pathway, the second acoustic input pathway, and the third acoustic input pathway and comprises a sound pick-up surface that faces a direction different than the first direction, the second direction and the third direction, and receives the first sound input, the second sound input, and the third sound input, and wherein the first sound input, the second sound input and the third sound input are acoustically summed at the reference microphone.

13. The microphone assembly of claim 12 wherein a sound input port to the first acoustic input pathway faces a different direction than a sound input port to the second acoustic input pathway.

14. The microphone assembly of claim 12 wherein the first acoustic input pathway and the second acoustic input pathway are connected at one end to the reference microphone, and at another end to different sound input ports in a headphone ear cup housing wall.

15. The microphone assembly of claim 12 wherein the housing is coupled to an interior surface of an ear cup housing wall of a headphone, and wherein the first acoustic input pathway is acoustically coupled to a first sound input port formed through the ear cup housing wall, the second acoustic input pathway is acoustically coupled to a second sound input port formed through the ear cup housing wall, and the third acoustic input pathway is acoustically coupled to a third sound input port formed through the earcup housing wall.

16. The microphone assembly of claim 12 wherein the first acoustic input pathway and the second acoustic input pathway are substantially the same length.

17. The microphone assembly of claim 12 wherein the reference microphone is operable to generate a reference audio signal indicative of the acoustically summed sound input for use in an active noise control system.

* * * * *